US005136520A

United States Patent [19]

Cox

[11] Patent Number: 5,136,520

[45] Date of Patent: Aug. 4, 1992

[54] SYSTEM FOR ASSIGNING DISCRETE TIME PERIODS FOR DYE APPLICATORS IN A TEXTILE DYEING APPARATUS

[75] Inventor: Steven W. Cox, Chesnee, S.C.

[73] Assignee: Milliken Research Corporation, Spartanburg, S.C.

[21] Appl. No.: 487,694

[22] Filed: Mar. 2, 1990

[51] Int. Cl.[5] ..... G06F 15/46

[52] U.S. Cl. ..... 364/470; 8/149

[58] Field of Search ..... 364/470, 469; 8/149, 8/151

[56] References Cited

U.S. PATENT DOCUMENTS 4,984,169 1/1991 Johnson, Jr. ..... 8/149 X

*Primary Examiner*—Jerry Smith
*Assistant Examiner*—Allen M. Lo
*Attorney, Agent, or Firm*—Kevin M. Kercher; H. William Petry

[57] ABSTRACT

A control system for a textile dying apparatus processes and distributes digitally encoded pattern information. A substrate is moved on a path along which the surface of the substrate comes into operative range of a plurality of arrays arranged along the path of the substrate. Each of the arrays has a plurality of individual dye applicators capable of selectively projecting a stream of dye onto a predetermined portion of the substrate corresponding to a pattern element in a pattern composed of a pattern element matrix with a plurality of pattern elements in each of a plurality of pattern rows. Each pattern element is associated with a visually distinct pattern area. The dye applicators project dye for a time period determined by the pattern information. The method first determines a set of initial values. From the initial values it generates a firing command matrix having, for each dye applicator in each array, a firing command sequence corresponding to the pattern element to which that dye applicator may apply dye in each pattern rows. Finally, the method allocates, for simultaneous transmission to each dye applicator in each array, the firing command sequence in the firing command matrix corresponding to the pattern element in the pattern row to be applied to the predetermined portion of the substrate that is passing within operative range of the dye applicator at the time of transmission.

17 Claims, 8 Drawing Sheets

"GENERATE GUN BAR DATA"

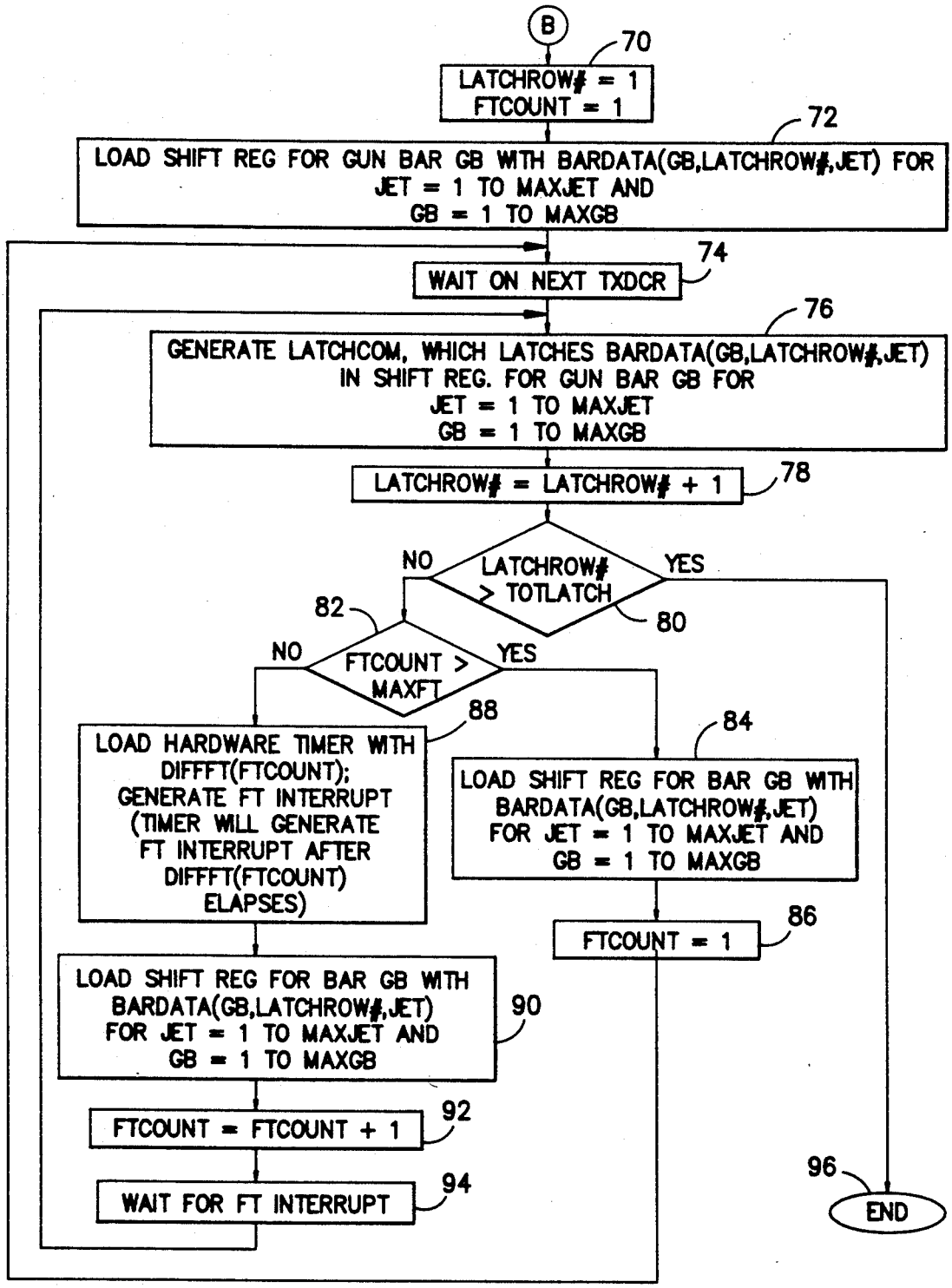
"OUTPUT GUNBAR DATA"
*FIG. —4—*

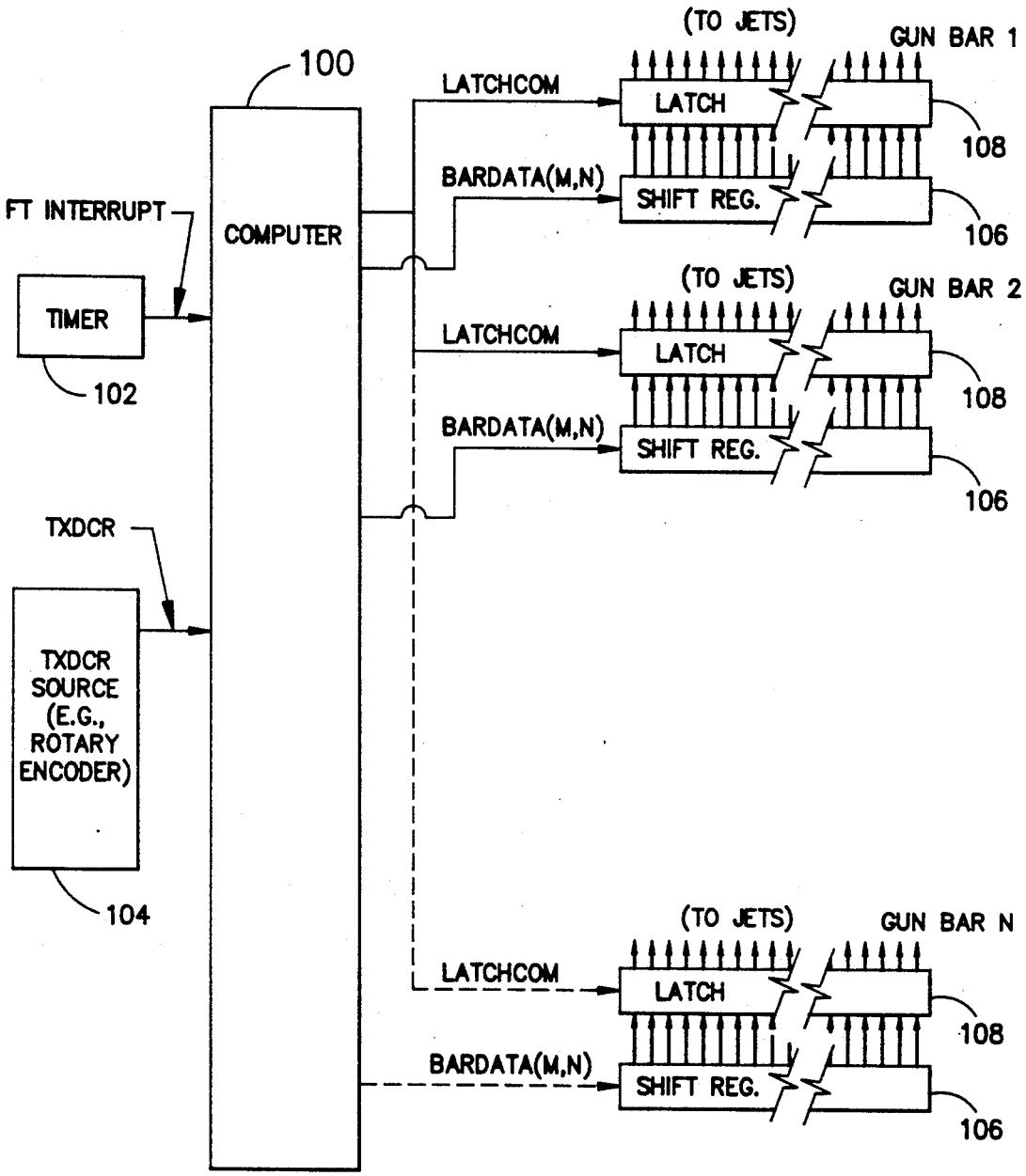
*FIG. –5–*

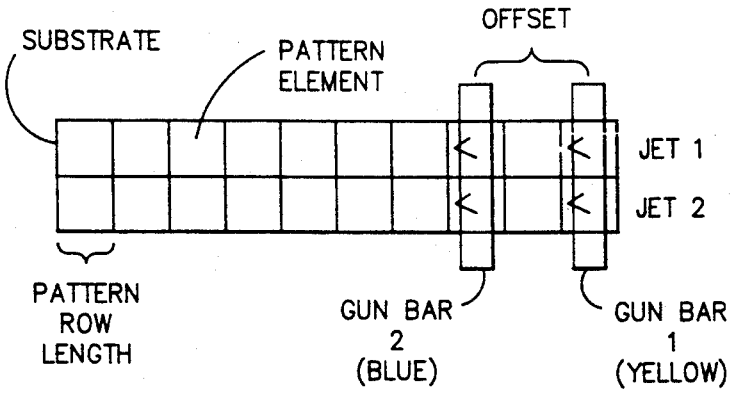
FIG. -6A-
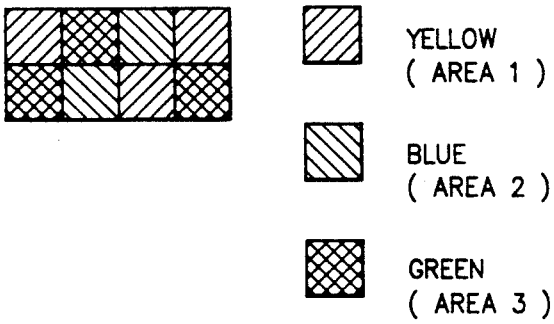
FIG. -6B-
PATTERN A
| JET # | 1 | 2 | 3 | 4 |
|---|---|---|---|---|
| 1 | 1 | 3 | 2 | 1 |
| 2 | 3 | 2 | 1 | 3 |
PATTERN ROW #
FIG. -6C-
| PATTERN AREA # | GUN BAR # 1 | GUN BAR # 2 |
|---|---|---|
| 1 | 20 | 0 |
| 2 | 0 | 20 |
| 3 | 10 | 10 |
FIG. -6D-
| | |
|---|---|
| FT (1) | 10 |
| FT (2) | 20 |
FIG. -6E-
| | |
|---|---|
| DIFFFT (1) | 10 |
| DIFFFT (2) | 10 |
FIG. -6F-

| TIMER CONTENT | LATCH COMMAND ROW # | GUN BAR 2 | JET # | GUN BAR 1 | TXDCR AND FT ACTION | ELAPSED TIME |
|---|---|---|---|---|---|---|
| | | | | | _TXDCR PATTERN LINE 1 | 0 MS |
| 10 MS | 1 | 0 | 1 | 1 | | |
| | | 0 | 2 | 1 | | |
| | | | | | _FIRING TIME INTERRUPT | 10 MS |
| 10 MS | 2 | 0 | 1 | 1 | | |
| | | 0 | 2 | 0 | | |
| | | | | | _FIRING TIME INTERRUPT | 20 MS |
| | 3 | 0 | 1 | 0 | | |
| | | 0 | 2 | 0 | | |
| | | | | | _TXDCR PATTERN LINE 2 | 100 MS |
| 10 MS | 4 | 0 | 1 | 1 | | |
| | | 0 | 2 | 0 | | |
| | | | | | _FIRING TIME INTERRUPT | 110 MS |
| 10 MS | 5 | 0 | 1 | 0 | | |
| | | 0 | 2 | 1 | | |
| | | | | | _FIRING TIME INTERRUPT | 120 MS |
| | 6 | 0 | 1 | 0 | | |
| | | 0 | 2 | 0 | | |
| | | | | | _TXDCR PATTERN LINE 3 | 200 MS |
| 10 MS | 7 | 0 | 1 | 0 | | |
| | | 0 | 2 | 1 | | |
| | | | | | _FIRING TIME INTERRUPT | 210 MS |
| 10 MS | 8 | 0 | 1 | 0 | | |
| | | 0 | 2 | 1 | | |
| | | | | | _FIRING TIME INTERRUPT | 220 MS |
| | 9 | 0 | 1 | 0 | | |
| | | 0 | 2 | 0 | | |
| | | | | | _TXDCR PATTERN LINE 4 | 300 MS |

*FIG. —8—*

SYSTEM FOR ASSIGNING DISCRETE TIME PERIODS FOR DYE APPLICATORS IN A TEXTILE DYEING APPARATUS

FIELD OF THE INVENTION

This invention relates to data distribution in a textile dyeing apparatus, and, more particularly, to a system assigning individual, discrete time periods to a multiple number of dye applicators in an array. The system may be used to control the selective application of dyes or other marking materials to a moving substrate.

In one embodiment, the textile dying apparatus comprises multiple arrays or gun bars of individually addressable dye jets, which gun bars are positioned across and along the path of the moving substrate. Each of the individually addressable dye jets may be assigned a distinct time period in which to dispense dye such that a pattern to be marked on the substrate can have an increased complexity. This allows the production of textile products having dramatically improved detail as well as subtlety of color or shade.

BACKGROUND OF THE INVENTION

The pattern-wise application of dye stuffs to textile materials involves a large quantity of digitally encoded pattern data which must be sorted and routed to a large number of individual dye jets. Typically, these systems include several arrays or gun bars comprised of individually controllable or addressable dye jets which are arranged and spaced in a parallel relation generally above and across the path of a moving web of substrate. For a given desired pattern, each gun bar is associated with a single color of dye. Each of the jets in the gun bar directs a stream of dye at the moving substrate to apply the correct pattern to the substrate. When the jet is "firing" dye is being applied to the substrate and when the jet is "not firing" no dye is dispensed.

Precise pattern resolution along the direction of the substrate travel depends primarily upon the speed and precision with which the individual dye streams can be made to strike or not strike the continuously moving substrate. A problem with the prior known dyeing devices is that the devices are limited in that the period of time during which any of the dye streams in a given gun bar are allowed to strike the substrate must be the same for all jets in the gun bar. In effect, these prior devices are incapable of allowing one jet to dispense dye onto the substrate for a different period of time than another jet in the same gun bar. This limitation is reflected in an inability to produce side-to-side shade variations simply by varying the quantity of dye applied to the substrate across the width of the given gun bar.

There is therefore needed a simple and efficient process and apparatus for individually assigning firing times to each dye jet across a gun bar.

SUMMARY OF THE INVENTION

By use of the novel programming described herein, as applied to the textile dying machines generally described above, textile products having dramatically improved detail as well as subtlety of color or shade may be produced. As discussed above, this invention is believed to be applicable to a variety of marking or patterning systems wherein large quantities of pattern data must be allocated and delivered to a large number of individually controllable imaging locations, and is not limited to use in connection with the patterning devices disclosed herein.

The present invention makes use of a programmable computer for assigning individual firing times to each dye jet across a gun bar. The method includes an initial value determination phase, a gun bar data generation phase and a gun bar data output phase.

During the initial value determination phase, based on the user's selection of the pattern to be applied to the substrate, an array of firing times is prepared as requested by the user corresponding to the pattern areas used in the selected pattern. This phase also determines the values of several variables that are used to control the operation of the subsequent phases. The gun bar data generation phase prepares an array of individual firing instructions for each jet in each gun bar. The individual firing instructions are then distributed during the gun bar data output phase to the physical apparatus.

It is an advantage of the present invention to provide an efficient software system whereby the individual firing times can be assigned to a plurality of jets in a gun bar.

The above discussion is a summary of certain deficiencies in the prior art and advantages of the invention described herein. Other advantages will be apparent to those skilled in the art from the detailed discussion of the invention that follows.

BRIEF DESCRIPTION OF THE DRAWINGS

FIG. 4 is a flow chart describing the operation of the present invention;

FIG. 5 is a schematic block diagram of the present invention;

FIGS. 6A–6F illustrate a simple example of the operation of the present invention;

FIG. 8 is a diagram illustrating the time sequence of operations performed in the example.

DETAILED DESCRIPTION

Figure 1A:
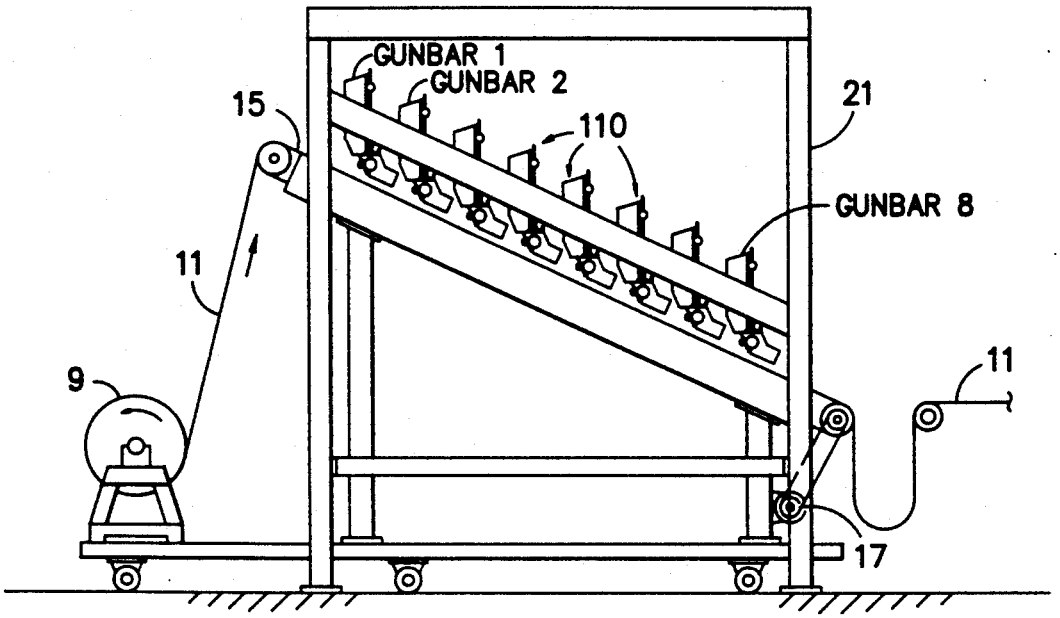
FIG. 1A is a perspective view of a gun bar which may be used in the apparatus of FIG. 1.

For purposes of discussion, the present invention will be described in conjunction with the metered jet patterning apparatus shown in FIG. 1. The patterning machine includes a set of eight individual gun bars 110 (gun bar 1 - gun bar 8) positioned within frame 21. Each gun bar 110 is comprised of a plurality of dye jets 111, perhaps several hundred in number, arranged in spaced alignment across the width of the gun bar, which gun bar extends across the width of the substrate 11. Substrate 11, for example, a textile fabric, is supplied from roll 9 and is transported through frame 21 and thereby under each gun bar 110 by conveyer 15 driven by a motor indicated generally at 17. After being transported under gun bars 110, substrate 11 may be passed through other dyeing related process steps such as drawing, fixing, etc.

An enlarged perspective view of one of the gun bars 110 and its associated operating hardware is shown in FIG. 1A. The gun bar 110 includes a plurality of dye jets 111 mounted in alignment, with an adjacent spacing appropriate to the degree of definition required by the pattern. Each dye jet 111 is comprised of a dye pipe 113 through which the dye may be pumped and a dispersing aperture 115 through which relatively high pressure air may be propelled. Further associated with each dye jet is an electronically controlled valve 117 which is interposed in the pressurized air lines 119 and 121 which serve to supply dispersing aperture 115 with pressurized air from manifold 123, which in turn is suitably connected, via regulator 125 and filter 127, to a source 129 of pressurized air. The operation of the valves 117 is controlled electronically by the programmable computer used by the method, illustrated schematically by controller 147. Associated with each dye pipe 113 is dye supply line 131 which extends from dye manifold 133, which in turn is fed, Via pressurizing pump 135 and filter 137 and associated conduits, from dye reservoir 139. Dye conduits 141 and 143 supply reservoir 139 with excess dye from manifold 133 and captured dye expelled by dye pipe 113 into containment trough 145, thus forming a recirculating dye system.

Figure 1B:
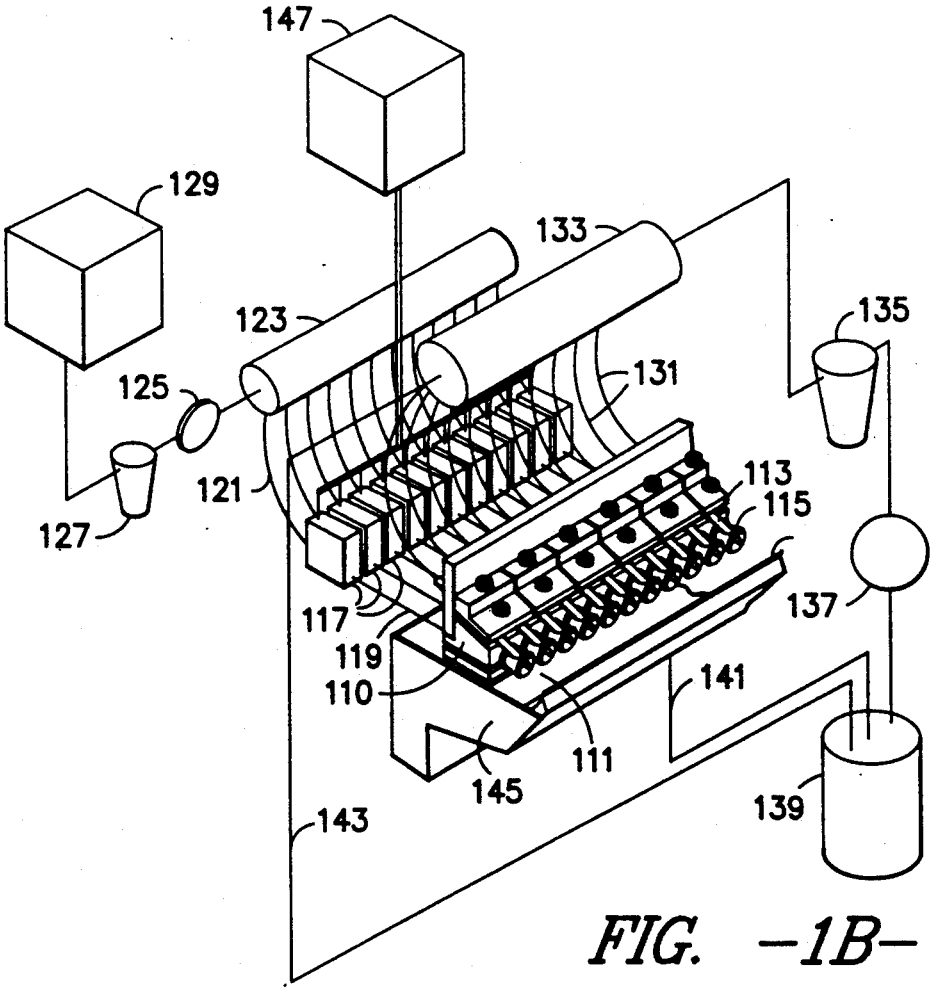
FIG. 1 is a diagrammatic side elevation view of a metered jet dyeing apparatus to which the present invention is particularly well adapted.

The apparatus described in FIGS. 1 and 1A is controlled by the programmable system of the present invention. Referring to the flow charts of FIG. 2 to FIG. 4, the operation of the present invention is divided conceptually into three parts or phases: initial value determination (FIG. 2); gun bar data generation (FIG. 3); and gun bar data output (FIG. 4). The flow charts describe the system for carrying out the method of the invention.

In the initial value determination phase (FIG. 2), based on the user's selection of the pattern to be applied to the substrate, an array of firing times is prepared as requested by the user corresponding to the pattern areas used in the selected pattern. The initial value determination phase also determines the values of several variables used to control the operation of the subsequent phases. In the gun bar data generation phase (FIG. 3), an array of individual firing instructions for each jet in each gun bar is prepared. In the gun bar data output phase (FIG. 4), the individual firing instructions for each jet in each gun bar are distributed. Each of these phases is discussed in greater detail below. It is understood that while the flow charts describe a textile dyeing apparatus using an array of gun bars to distribute the dye, the invention is applicable to any apparatus requiring different digital information to be supplied to a plurality of devices.

In order to more clearly understand the present invention, the following definitions, which are referred to throughout the description, are provided:

BARDATA(GB, LATCHROW#, JET) - A bit array of binary states indicating firing status of each jet for a given gun bar.

BAROFF(GB) - Gun bar offset=The total number of transducer pulses TXDCR between gun bar 1 and gun bar GB.

DIFFFT(N) - The difference (in time units) between FT(N) and FT(N−1), where FT(0)=0.

FIRING TIME, FT - Elapsed time during which a dye jet is "on" (i.e., dispensing dye).

FTCOUNT - Different firing time counter (from 1 to MAXFT).

GB - Gun bar identification number (GB=1, 2, . . . , MAXGB).

JET - Jet position counter across a given gun bar (JET=1, 2, . . . , MAXJET).

LATCHCOM - Command (sent to the gun bar latches) to latch BARDATA, thereby causing appropriate jets to fire for the time interval until the next LATCHCOM. LATCHROW#- Latch row counter (LATCHROW#=1, 2, . . . , TOTLATCH).

MAXBAROFF - Total number of transducer pulses TXDCR between gun bar 1 and gun bar MAXGB.

MAXFT - Total number of discrete firing times.

MAXGB - Maximum number of gun bars.

MAXJET - Total number of dye jets per gun bar.

PATTERN AREA #- Assigned identification number of a visually distinct region of the pattern which, in combination with all other such regions, comprises the overall pattern.

PATTERN LENGTH - Total number of pattern rows in the selected pattern (equal to the total number of transducer pulses TXDCR, disregarding gun bar offset BAROFF, needed to produce the selected pattern).

PATROW#- Pattern element row counter (based upon TXDCR count; PATROW#=1, 2, . . . , PATTERN LENGTH).

SOURCE PATTERN(M,N) - Array of PATTERN AREA#s (M=PATROW#, N=JET).

TOTLATCH - Total number of latch commands (LATCHCOM) sent to each gun bar to produce the selected pattern.

TXDCR - Transducer pulse, generated at each advance of a predetermined fixed length of substrate (e.g., the output of a rotary encoder in contact with a moving substrate).

Figure 2:
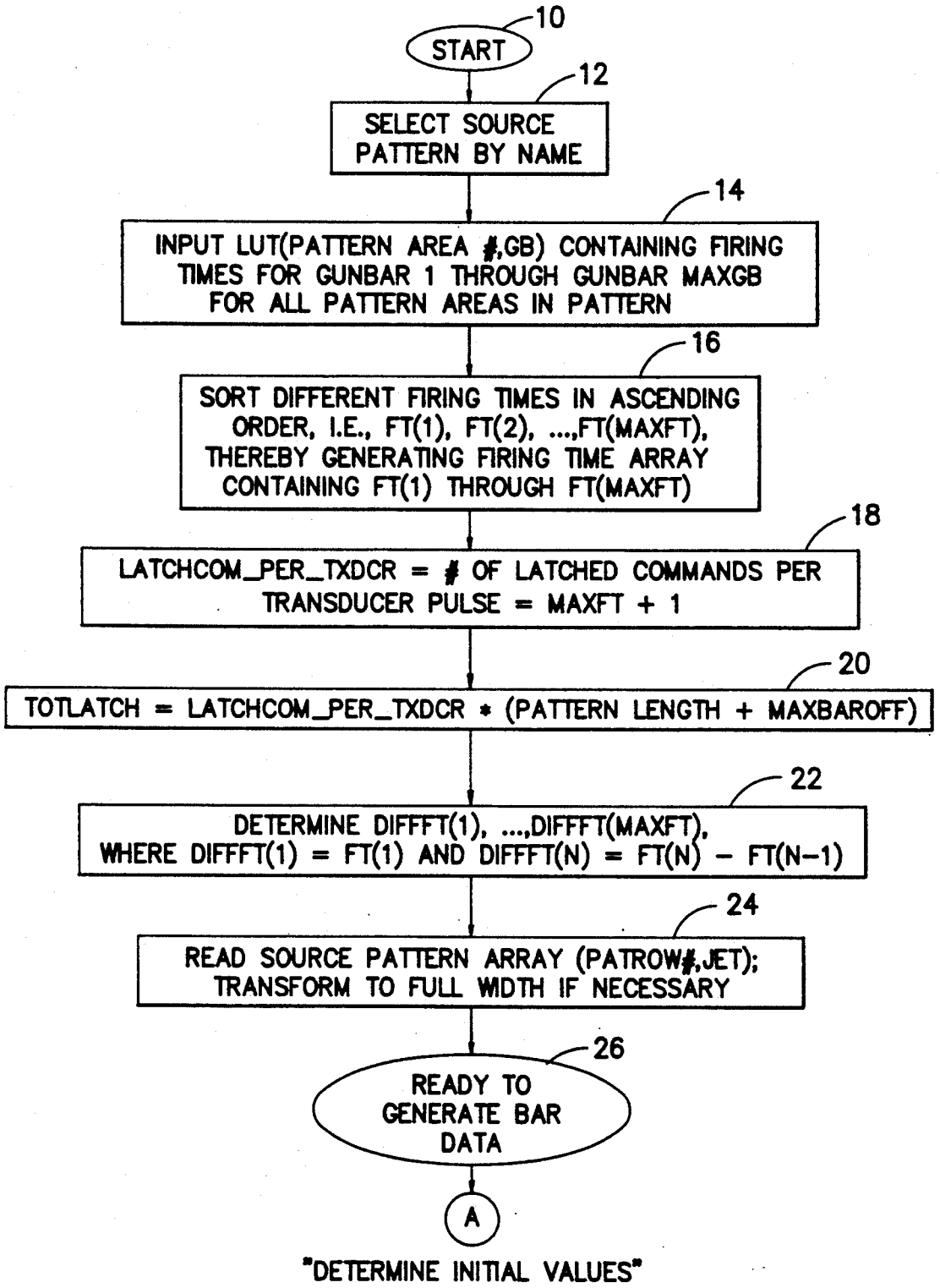
FIG. 2 is a flow chart describing the operation of the present invention.

The initial value determination phase, shown in FIG. 2, prepares an array of firing times corresponding to pattern areas used in the pattern and determines the value of several variables used to control the subsequent phases' operation. After beginning the method at 10, the next step 12 is for the user to select the pattern to be applied to the substrate. The pattern is chosen by name from among a number of available patterns. Corresponding to each pattern name is a two-dimensional source pattern array of pattern area identification codes PATTERN AREA #. The array is formed with one dimension corresponding to pattern row number PATROW # and the other to individual dye jet number JET, forming a two-dimensional matrix in which each cell in the matrix corresponds to a pattern element in the pattern to be applied to the substrate. The pattern area identification code in an individual cell of the matrix is an 8-bit unit uniquely identifying the pattern area to be associated with that pattern element.

Another two-dimensional data array, referred to as a look up table LUT, contains firing time data for the jets in each array. One dimension of this array corresponds to the pattern area number and the other to the gun bar number GB. Each cell in this array contains the firing time required for a jet in a particular gun bar to produce the specified pattern area. Method step 14 associates the source pattern array with the LUT to identify all of the discrete, non-zero firing times for any jet in any gun bar required to produce the selected pattern. These times are input by the user. Step 16 sorts the different firing times into ascending order and creates an arrayed string of firing times FT having a length MAXFT where MAXFT is the number of different firing times in the LUT. The first element in the string, FT(1), is the minimum firing time, while the last element, FT(MAXFT), is the maximum firing time for any jet in any gun bar.

The next steps 18 and 20 in the initial value determination phase calculate the values of two variables which control the operation of the subsequent phases. The first is the total number of latched commands TOTLATCH that must be issued to generate the pattern. A number of latched commands are issued to generate each pattern row in the pattern. The latch command is a command, sent to the latch (106 of FIG. 4) associated with each gun bar, to store the bar data BARDATA which causes the appropriate dye jets to fire for a time interval until the next LATCHCOM. The number of latched commands to be issued to generate one pattern row, LATCHCOM_PER_TXDCR, is one greater than the total number of firing times, MAXFT. The total number of latched commands that must be issued to generate the entire pattern depends on the number of pattern rows in the pattern and on the relative geometries of the gun bars. Firing instructions must be transmitted to the jets from the time the first pattern row passes by the first gun bar until the last pattern row passes by the last gun bar. The effective number of pattern rows that must be controlled is therefore the number of pattern rows in the pattern plus the number of pattern rows encompassed in the distance between the first gun bar and the last gun bar. The total number of latched commands required to generate the pattern is therefore the product of the number of latched commands per pattern row LATCHCOM_PER_TXDCR and the effective number of pattern rows, which is PATTERN LENGTH plus the maximum gun bar offset MAXBAROFF.

From the firing time string FT the method's next step 22 calculates a string of firing time differences DIFFFT having the same length as FT. The value of each element in the firing time difference string DIFFFT is the difference between the firing time in the corresponding element in FT and the preceding element in FT. For example, for the 3 element string FT where FT(1)=10 ms, FT(2)=25 ms, and FT(3)=30 ms, the values of DIFFFT would be DIFFFT(1)=10 ms, DIFFFT(2)=15 ms, and DIFFFT(3)=5 ms.

In the next step 24 of the initial value determination phase, the source pattern array may be transformed to full width if necessary. The width of the pattern to be applied to the substrate may be less than the full width of the substrate. Therefore, the source pattern table would need to be transformed to full width by either adding null value information or repeating the source pattern. For example, a 24 inch wide pattern applied to a 48 inch wide substrate would only fill half of the substrate, thus wasting substrate material. In such a case, the source pattern array would specify pattern areas for only one half of the dye jets. The method therefore could transform the source pattern array by doubling the width dimension of the array and copying the pattern information in the first half of the array into the newly-created second half. The resulting source pattern array would produce two patterns and utilize all of the jets across the gun bars. The initial value determination phase then terminates at step 26 when the method is ready to generate gun bar data.

Figure 3:
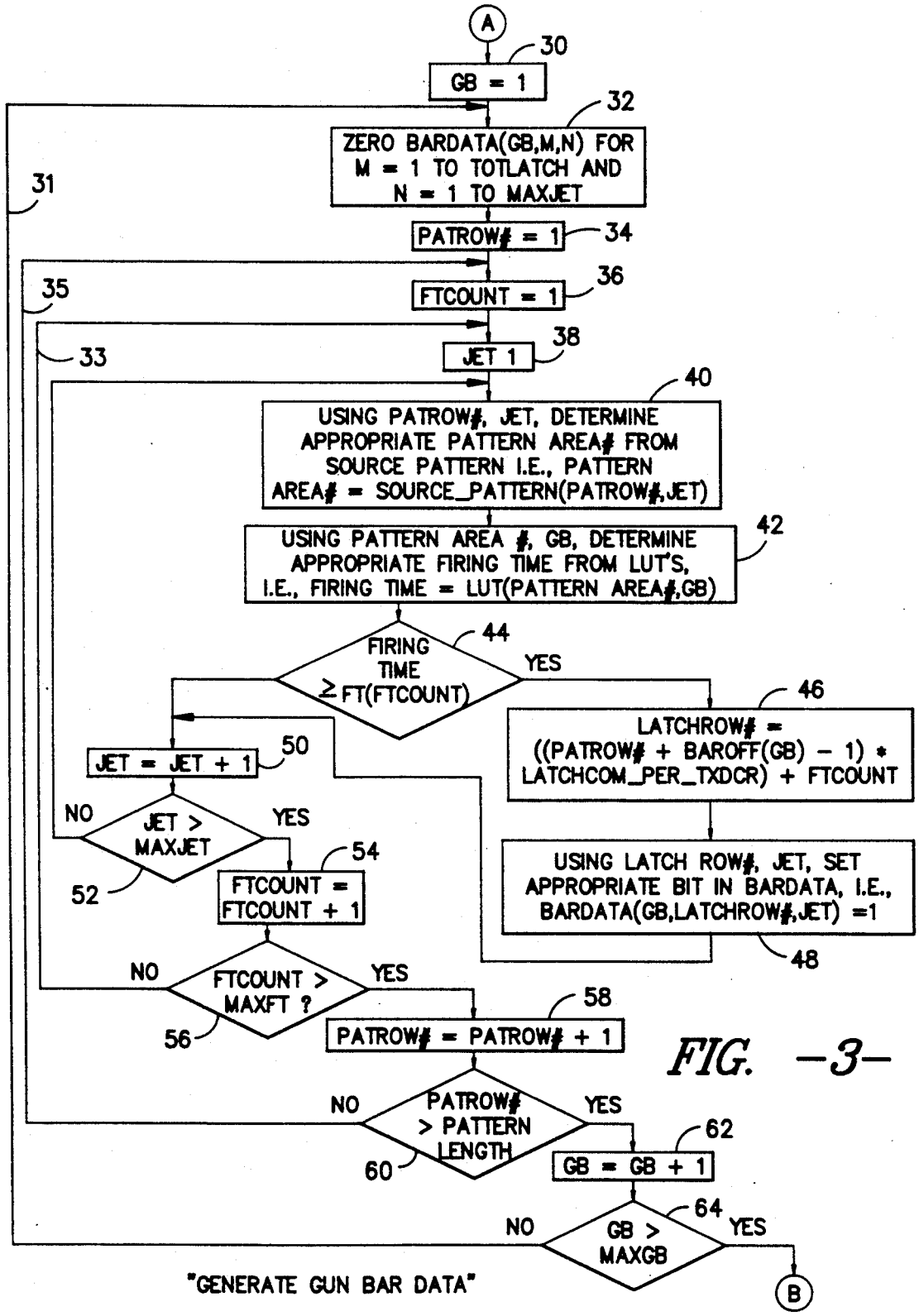
FIG. 3 is a flow chart describing the operation of the present invention.

Referring to FIG. 3, there is shown the gun bar data generation phase. In this phase, an array of individual firing instructions for each jet in each gun bar is prepared. The firing instruction array BARDATA is a three-dimensional array (GB, LATCHROW#, JET) with the first dimension corresponding to the gun bar number GB, the second dimension to latch command number LATCHROW#, and the third dimension to dye jet number JET. Each cell in the array contains a single bit, set to 1 if the individual jet in the particular gun bar is to be firing during the time period corresponding to the particular latch command. The array is filled with firing instructions in an iterative process. The following process is followed for each plane in the array, corresponding to a single gun bar.

The first step 30 in the array-filling process is to initialize the gun bar counter GB to 1, which means that the method first prepares firing instructions for gun bar 1. In the next step 32, the method initializes each cell in the current plane (GB, LATCHROW#, JET where GB=1, LATCHROW#=1 to TOTLATCH, and JET=1 to MAXJET) of the array to zero. The process then executes a three-tiered set of nested loops designated generally as 31, 33 and 35, respectively. The three looping counters are: 1) the pattern row number 58 PATROW# (ranging from 1 to the total number of pattern rows in the pattern); 2) the firing time counter 54 FTCOUNT (ranging from 1 to the number of firing times MAXFT in the firing time string FT); and 3) the jet number 50 JET (ranging from 1 to the number of jets in a gun bar). In steps 34, 36, and 38, these counters are initialized to 1. The following steps are then executed within the nested loops.

In the first step 40 within the nested loops 31, 33, 35, the pattern area identification code for the pattern element identified by the current pattern row (PATROW#) and the current jet (JET) is read from the transformed source pattern array. In the next step 42, the corresponding firing time for the current jet is read from the LUT based on the pattern area identification code just read and the current gun bar number. In step 44 the firing time is compared to the firing time in the element of the firing time string FT corresponding to the current value of the FTCOUNT looping counter 31. If the required firing time is greater than the current firing time value in string FT, then the method proceeds to steps 46 and 48, in which the bit in the appropriate row of the firing instruction array (BARDATA) is set to a 1. This signifies that the current jet in the current gun bar should be firing during the time period ending with the current firing time value in FT while the location on the substrate on which the current pattern row is to be applied is passing by the current gun bar.

The row of the firing instruction array in which the bit is set to 1 (i.e. the latch command number to which the firing instruction is assigned) is determined in step 46 and depends on the current pattern row number, the current gun bar number, the current gun bar offset, and the current firing time counter number, in the following relationship:

$$\text{LATCHROW\#} = \left(\left(\begin{pmatrix}\text{PATROW\#}\\ + \\ \text{BAROFF(GB)}\end{pmatrix} - 1\right) * \text{LATCHCOM_PER_TXDCR}\right) + \text{FTCOUNT}$$

The bit in cell BARDATA(GB, LATCHROW#, JET) is then set to 1 in step 48 and the method proceeds to step 50.

If the required firing time is less than the current firing time value in string FT, then no change is made to the firing instruction array. This leaves the default bit value of zero at the position in the firing instruction array to which a 1 would have been written, signifying that the current jet in the current gun bar should not be firing during the time period ending with the current firing time value in FT while the location on the substrate on which the current pattern row is to be applied is passing by the current gun bar. The method then proceeds to step 50 and the firing instruction calculations are then repeated as each looping counter is incremented through its range and each loop 31, 33, 35 successively completed.

First, in step 50, the JET looping counter is incremented by one, and then, in step 52, the value of JET is tested to determine if firing instructions have been generated for all of the jets in the current gun bar for the current pattern row (i.e., if JET exceeds MAXJET). If not, the process inside the JET loop 31 (i.e., steps 40 to 50) is repeated until all of the jets have been treated. The method then proceeds to step 54, where the FTCOUNT looping counter is incremented and to step 56, where the value of FTCOUNT is tested to determine if firing instructions have been generated for all firing times for all jets in the current gun bar for the current pattern row (i.e., if FTCOUNT exceeds MAXFT). If not, the process inside the FTCOUNT loop 33 (i.e., steps 38 to 54) is repeated until all of the firing times for all of the jets have been addressed. The method then proceeds to step 58, where the PATROW# looping counter is incremented and to step 60, where the value of PATROW# is tested to determine if firing instructions have been generated for all firing times for all jets in the current gun bar for all pattern rows in the pattern (i.e, if PATROW# exceeds PATTERN LENGTH). If not, the process inside the PATROW# loop 35 (i.e., steps 36 to 56) is repeated until all of the firing times for all of the jets for all of the pattern rows in the pattern have been treated.

Finally, the process proceeds to step 62, where the looping counter GB is incremented and to step 64, where the value of GB is tested to determine if firing instructions have been generated for all firing times for all jets in all gun bars for all pattern rows in the pattern (i.e, if GB exceeds MAXGB). If not, the entire looping process described above (steps 32 to 60) is repeated for each gun bar, until firing instructions have been generated for all firing times for all jets for all pattern rows for all gun bars. The completed firing instruction array is then used in the gun bar data output phase of FIG. 4.

Referring to FIG. 4, there is shown the gun bar data output phase. In this phase, the individual firing instructions are distributed to each jet in each gun bar at the appropriate time to deposit the appropriate amount of dye in the appropriate location to form the desired pattern area in the desired location on the substrate. To accomplish this, the method controls the hardware elements shown schematically in the block diagram of FIG. 5. Each gun bar (GB 1 to GB N) is equipped with a latch 108 and a shift register 106 through which the firing instructions are routed to control the firing of the individual jets in the gun bar. The method is executed in a computer 100. Inputs to the computer 100 are received from a transducer source 104 and a timer 102. The transducer source 104, which can be, for example, a rotary encoder, is in contact with the substrate and sends transducer pulses TXDCR at each advance of a predetermined fixed length of the substrate, usually the length of a pattern row. The timer 102 is used as a source of firing time interrupts used for a purpose described below.

In the first step 70 of the gun bar data output phase shown in FIG. 4, two counters, LATCHROW#, which counts latch rows, and FTCOUNT, which counts firing times in the firing time string FT, are initialized to 1. In the next step 72 the shift register 106 for each gun bar is loaded with a single firing instruction for each of the jets in the gun bar from the firing instruction array BARDATA. The firing instructions are loaded from the plane of BARDATA corresponding to the first latch row number. The method then proceeds to step 74, where it awaits a transducer pulse TXDCR. When a transducer pulse is received from the transducer source 104, the method proceeds to step 76, where it generates a latch command LATCHCOM, which latches the data in the shift register 106, thus causing the appropriate jets to fire during the time interval until the next LATCHCOM is generated.

In the next step 78 of the method, the LATCHROW# counter is incremented and in step 80 LATCHROW# is tested to determine if the firing instructions in all of the latch command rows in the firing instruction array BARDATA have been executed (i.e., if LATCHROW# exceeds TOTLATCH). If so, no more dye is to be applied to the substrate, and the method proceeds to step 96, where it terminates operation. Otherwise, the method proceeds to step 82, where the firing time counter FTCOUNT is tested to determine if the longest firing time in the firing time string FT has elapsed (i.e., if FTCOUNT exceeds MAXFT). If so, the method proceeds to step 84, where the shift registers for each of the gun bars are loaded with firing instructions from the next row in BARDATA, corresponding to the latch command number after the one which had just been executed. FTCOUNT is then reset to 1 in step 86, and the method returns to step 74, where it awaits the next transducer pulse TXDCR, upon which the operation described above for steps 74 to 86 is repeated.

If the firing time counter FTCOUNT has not yet exceeded the number of firing times MAXFT (that is, if the longest firing time in the firing time array FT has not elapsed since the last transducer pulse), the method proceeds to step 88, where the timer is loaded with the next value in the firing time differences string DIFFFT. In the next step 90, the shift registers are loaded with data for the next firing command number. The method then increments the firing time counter FTCOUNT in step 92 and proceeds to step 94 where it awaits a firing time interrupt from the timer !02. When the interrupt is received, the method returns to step 76, where it generates a latch command LATCHCOM and repeats the subsequent steps described above.

The operation of the method described above can be better understood by use of the numerical example given below. The example shows the operation of the method in a rudimentary dye application system having two gun bars, each with two dye jets. The resolution of the system is assumed to be one inch, so that the size of a pattern element is one inch by one inch, and the substrate is two inches wide. Gun bar 1 applies yellow dye and gun bar 2 applies blue dye. The offset between the two gun bars is two inches, or two pattern rows. These relationships in the system are illustrated schematically in FIG. 6A.

The pattern to be generated by the method is identified as pattern A, shown in FIG. 6B. Pattern A incorporates three pattern areas: #1 (yellow), #2 (blue), and #3 (green). The source pattern array containing this information is shown in FIG. 6C. The LUT is shown in FIG. 6D. This array indicates that to form pattern area 1 (yellow) a jet in gun bar 1 must fire for 20 ms, while a jet in gun bar 2 does not fire at all. To form pattern area 2 (blue) a jet in gun bar 1 does not fire at all, while a jet in gun bar 2 fires for 20 ms. To form pattern area 3 (green) a jet in gun bar 1 must fire for 10 ms and a jet in gun bar 2 must also fire for 10 ms. The firing time string FT therefore contains two values: 10 ms and 20 ms, the only two firing times used in pattern A, as shown in FIG. 6E. The length MAXFT of string FT is 2. The firing time difference string DIFFFT contains two values, both 10 ms, as shown in FIG. 6F.

Three latched commands (one greater than the number of firing times MAXFT) must be issued for each pattern row, so the value of LATCH-COM_PER_TXDCR is 3. The effective number of pattern rows in the pattern is six (the pattern contains four pattern rows, and the offset between gun bars is two pattern rows). The total number of latched commands TOTLATCH that must be issued for the pattern is therefore 18 (3×6). Since it is assumed that the pattern occupies the full width of the substrate, it is not necessary to transform the pattern in this example.

Figure 7A:
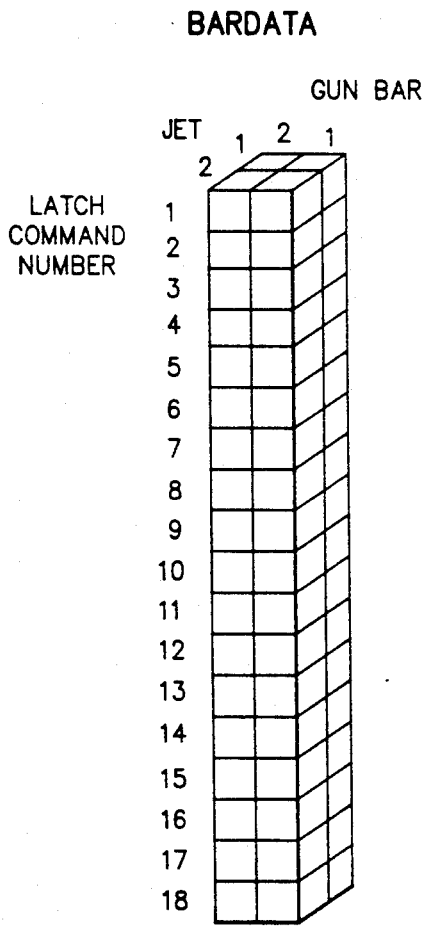
FIGS. 7A and 7B further illustrate the example of FIGS. 6A–6F.
Figure 7B:
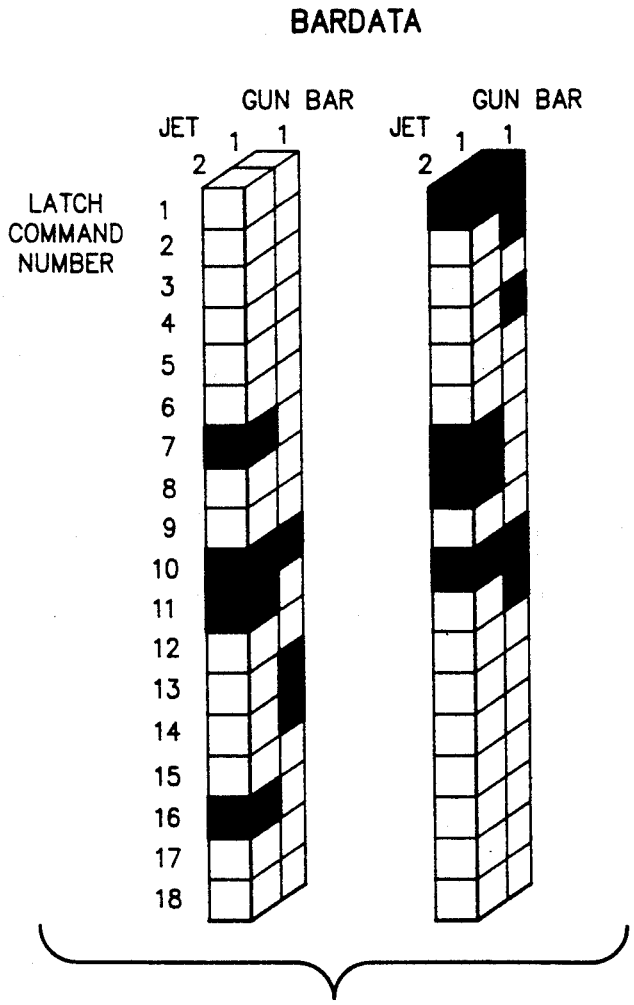

The gun bar data generation phase is illustrated in FIGS. 7A and 7B. The three-dimensional firing instruction array BARDATA is shown schematically in FIG. 7A. The array has two planes (one for each gun bar) of 18 rows (one for each of the 18 latch commands) and 2 columns (1 for each jet). In the first step of the array-filling process, the 2-cell by 18-cell gun bar 1 plane is initialized with zeros in all of the cells. The iterative portion of the array-filling process then begins. In this example, the looping counters are looped to the following maximum values: PATROW#- 4; FTCOUNT - 2; JET - 2. The operations in the looping process on the plane in BARDATA corresponding to gun bar 1 are illustrated below. FIG. 7B shows the two planes of BARDATA separated and the firing instructions written to those planes in this phase. A 1 is indicated in a particular cell by shading the cell.

As the first execution step within the nested loops, the method reads the pattern area code from the source data array for pattern row number 1 and jet 1; this is pattern area code 1. In the next step, the firing time corresponding to pattern area code 1 is read from the LUT. The firing time is 20 ms. This firing time is then compared to the firing time in element FT(FTCOUNT) of the firing time string FT. FTCOUNT is still 1 at this point in the method's execution, so the firing time FT(1)=10 ms is compared to the required firing time of 20 ms. Since the required firing time is greater than FT(FTCOUNT), the appropriate bit in BARDATA must be set to 1 to indicate that the jet should be fired during the first firing time interval. The appropriate location for that bit is determined as follows.

Since the firing time counter FTCOUNT is 1, the bit should be put in the first latch command row of the appropriate set of latch command rows within BARDATA for the effective pattern row. The effective pattern row is determined by the current PATROW# value (in this case, 1) and the number of pattern rows by which the current gun bar is offset from the first gun bar (0 in this case because the first gun bar is being treated). In this case, the effective pattern row number is 1, so the bit is placed in the first latch command row in BARDATA. If, for example, the second gun bar was being treated in this step, the bit would be placed in latch command row 7, because the second gun bar is offset by 2 pattern rows (each comprising 3 latch command lines) from the first gun bar.

In the next execution step, the JET counter is incremented and the pattern area lookup, firing time lookup, and firing time comparison is conducted again. For the second jet, the pattern area code number is 3, for which the gun bar 1 firing time is 10 ms. Since this is equal to the FT(FTCOUNT) value of 10 ms, a 1 bit is again written to BARDATA, again in the first latch command row of the plane corresponding to gun bar 1. In the next outward loop of this phase of the method, the FTCOUNT looping counter is incremented. In this loop, the firing times required by each jet to produce the required pattern areas are compared to the firing time in FT(2), which is 20 ms, to determine if a 1 should be written to the appropriate cell in BARDATA. In this example, jet 1 would fire (firing time for pattern area 1 is 20 ms) while jet 2 would not (firing time for pattern area 3 is 10 ms). In the second latch command row of BARDATA for gun bar 1, a 1 would therefore be written for jet 1, but not for jet 2. Because MAXFT is 2, the FTCOUNT loop ends at this point, and PATROW# is next incremented and its loop repeated. In this loop, jet 1 is to produce a pattern area 3 and jet 2 is to produce pattern area 2. The respective firing times for jet 1 and jet 2 are thus 10 ms and 0 ms. Therefore, a 1 is written in latch command row 4 for jet 1, but not for jet 2. Nothing is written to latch command row 5 for these jets in this pattern row because neither jet fires longer than 10 ms. Note that latch command row 3 has not been addressed in the previous loop of PATROW#. The last latch command row for each pattern row is left with zeros in the cells to indicate that after the maximum firing time for any jet in each pattern row, no jets fire until the next pattern row. This is illustrated later in the example.

When all of the pattern rows have been treated and binary 1s written to the appropriate cells in the plane of BARDATA corresponding to gun bar 1, the process is repeated for gun bar 2. As an example, in the first pattern row, the firing times for jets 1 and 2 are 0 ms and 10 ms, respectively, corresponding to pattern areas 1 and 3. For the first pattern row the method therefore writes a 1 to the cell corresponding to jet 2, but not to jet 1, in latch command row 7 (reflecting, as noted above, that gun bar 2 is offset two pattern rows from gun bar 1). The method does not write a 1 in either of the cells in latch command row 8 because neither jet in gun bar 2 fires for longer than 10 ms to form the pattern areas in the first pattern row. The completed BARDATA array is shown in FIG. 7B.

After the gun bar data generation phase is completed, the method executes the gun bar data output phase. In this phase the data from BARDATA is loaded into the gun bar shift registers 106 and then latched to the dye jets in response to interrupts from the timer 102. The operation of this phase is illustrated in FIG. 8, where the contents of the shift registers for the first nine latch command lines are shown along with the sequence of firing time interrupts, the content of the timer, and the overall elapsed time.

The two shift registers 106 (one for gun bar 1 and one for gun bar 2) are initially loaded with the firing instructions from the first latch command row of BARDATA. When a transducer pulse TXDCR is received, the data is latched to the dye jets. (A LATCHCOM is generated, thus transferring the data from shift registers 106 to latch 108 thereby turning the appropriate jets on or off.) The interrupt timer 102 is loaded with the first value of the firing time difference string DIFFFT, which in this example is 10 ms. During the time the timer is delaying for the 10 ms, the method loads the next latch command row into the shift register from BARDATA, as shown in step 90. The method then waits for a firing time interrupt, as shown in step 94. After 10 ms have elapsed, the timer 102 sends a firing time interrupt, upon which the method latches the next, preloaded latch command row from BARDATA into latch 108 which latches the firing instructions to the dye jets. As shown in the example, both jets in gun bar 1 are instructed to fire on the first latch command row. However, after the first firing time interrupt, the second latch command row is latched, in which dye jet 2 is instructed to stop firing. It remains in a non-firing mode for two more pattern rows, when, in latch command row 7, it receives another instruction to fire. Assuming that the substrate is transported at the rate of one pattern row distance every 100 ms, the elapsed time between transducer pulses is 100 ms, and the total time from the initiation of the pattern can be tracked as shown in FIG. 8.

What is claimed is:

1. A patterning method comprising:

a. moving a substrate on a path;

b. arranging a plurality of arrays in operative range along the path of the substrate, each of the arrays having a plurality of individual dye applicators capable of selectively projecting a stream of dye onto a predetermined portion of the substrate corresponding to a pattern element in a pattern composed of a pattern element matrix with a plurality of pattern elements in each of a plurality of pattern rows, each pattern element being associated with a visually distinct pattern area;

c. determining a set of initial values; wherein the initial value determination step comprises the steps of:

1. selecting the pattern comprising a two-dimensional pattern area code matrix, each element of the pattern area code matrix having a pattern area code identifying one of the pattern areas, a first dimension of the two-dimensional pattern area code matrix corresponding to the number of pattern rows in the pattern and a second dimension of the two-dimensional pattern area code matrix corresponding to the number of pattern elements in the pattern;

2. accepting for each pattern area in the pattern a firing time for the dye applicators in each array required to produce the pattern area, the firing time being the length of time during which a dye applicator projects dye onto the substrate;

3. determining the values of control variables used to control the operation of subsequent steps in the method, the control variables comprising a number of firing commands to be issued to dye applicators for a pattern row, a firing command time interval associated which each of the firing commands, and an aggregate firing command time interval associated which each of the firing command time intervals; and d. generating from the set of initial values a firing command matrix having, for each dye applicator in each array, a firing command sequence corresponding to the pattern element to which that dye applicator may apply dye in each pattern row; and e. allocating, for simultaneous transmission to each dye applicator in each array, the firing command sequence in the firing command matrix corresponding to the pattern element in the pattern row to be applied to the predetermined portion of the substrate that is passing within operative range of the dye applicator at the time of transmission.

2. The method of claim 1 wherein the step of selecting a pattern comprises identifying the pattern by name from among a plurality of named patterns.

3. The method of claim 1 wherein the firing times for the selected pattern are contained in a two-dimensional firing time matrix with a first dimension corresponding to the number of arrays and the second dimension corresponding to the number of pattern areas in the pattern.

4. The method of claim 1 wherein the step of determining the values of control variables comprises the steps of:

a. identifying distinct firing times required in the selected pattern;

b. sorting the distinct firing times into ascending order;

c. placing the sorted distinct firing times into a firing time string;

d. determining the number of firing commands required to produce a pattern row in the pattern, being one greater than the number of distinct firing times in the firing time string;

e. determining the effective number of pattern rows in the pattern, being the sum of the number of pattern rows in the pattern and the number of pattern rows contained in the maximum distance along the substrate between any two arrays;

f. determining the number of firing commands required to produce the pattern, being the product of the number of firing commands per pattern row and the effective number of pattern rows; and g. generating a firing command time interval string having its first element equal to the first element in the firing time string, and each remaining element equal to the difference between the firing time in the corresponding element of the firing time string and the next shortest firing time.

5. The method of claim 1 further comprising the steps of:

a. determining if the number of pattern elements in the pattern rows of the pattern is less than the number of dye applicators in the arrays and, if so;

b. generating a transformed two-dimensional pattern area code matrix having a first dimension equal to the number of pattern rows in the pattern and a second dimension equal to the number of dye applicators in the arrays, containing pattern area codes identical to those in the pattern area code matrix repeated an integer number of times across the second dimension of the transformed pattern area code matrix, if possible, and containing in its remaining cells null values.

6. The method of claim 1 wherein the step of generating a firing command matrix comprises the steps of:

a. placing a firing command in the firing command matrix for a dye applicator in an array if the dye applicator must, in accordance with the pattern information, project dye during a firing command time interval;

b. repeating step (a.) for each dye applicator in an array;

c. repeating steps (a.) and (b.) for each firing command time interval;

d. repeating steps (a.), (b.), and (c.) for each pattern row in the pattern; and e. repeating steps (a.), (b.), (c.), and (d.) for each array.

7. The method of claim 6 wherein the step of placing a firing command in the firing command matrix comprises the steps of:

a. determining if the dye applicator must, in accordance with the pattern information, project dye during the firing command time interval;

b. if the dye applicator must project dye during the firing command time interval, determining a required location in the firing command matrix in which a firing command must be placed so that the command will be executed when the portion of the substrate to which the pattern element on which the pattern area produced by the firing command is to be applied is within operative range of the dye applicator; and c. placing the firing command in the required location in the firing command matrix.

8. The method of claim 7 wherein the step of determining if a dye applicator must project dye during a firing command time interval comprises the steps of:

a. determining from the pattern information the pattern area code corresponding to the pattern element that is in operative range of the dye applicator during the firing command time interval;

b. determining the firing time corresponding to the determined pattern area code; and c. comparing the determined firing time to the aggregate firing command time interval associated with the firing command time interval.

9. The method of claim 7 wherein a. the firing command matrix comprises a three dimensional matrix having a plurality of firing command planes, each plane having a first dimension corresponding to the number of dye applicators in an array and a second dimension corresponding to the number of arrays, each plane containing a single firing command for each dye applicator in each array; and b. the step of determining the location in the firing command matrix comprises the steps of:

i. determining the plane in the firing command matrix to which the firing command would be written if the firing command were for a dye applicator in the first array; and ii. shifting the determined plane by the number of pattern rows contained in the distance between the array in which the dye applicator is contained and the first array.

10. The method of claim 7 wherein the step of allocating the firing command sequence comprises the steps of:

a. writing to each of a plurality of digital memories, one digital memory being associated with each array, the first firing command in the firing command matrix for each dye applicator in each array;

b. in response to a first control signal, transferring the firing command from the digital memory to each dye applicator in each array;

c. initializing the value of an elapsed time counter to correspond to the firing command time interval associated with the firing command;

d. loading the digital memory with the next firing command in the firing command matrix;

e. in response to a second control signal, being issued by the elapsed time counter when the firing command time interval has elapsed, transferring the firing command from the digital memory to each dye applicator in each array;

f. repeating steps (c.), (d.), and (e.) until all of the firing commands associated with a pattern row have been issued to the dye applicator;

g. repeating steps (b.) (c.), (d.), (e.), and (f.) iteratively until all of the firing commands in the firing command matrix have been issued.

11. A method for applying dye to textile material in a predetermined pattern, comprising;

a. moving a textile material substrate on a path;

b. arranging a plurality of gun bars in operative range along the path of the textile material substrate, each of the gun bars having a plurality of individual dye applicators, each of the dye applicators having its own respective controller and being capable of selectively projecting a stream of dye onto a predetermined portion of the textile material substrate corresponding to a pattern element in a pattern composed of a pattern element matrix with a plurality of pattern elements in each of a plurality of pattern rows, each pattern element being associated with a visually distinct pattern area;

c. providing digitally-encoded pattern information;

d. selecting the pattern comprising a two-dimensional pattern area code matrix, each element of the pattern area code matrix having a pattern area code identifying one of the pattern areas, a first dimension of the two-dimensional pattern area code matrix corresponding to the number of pattern rows in the pattern and a second dimension of the two-dimensional pattern area code matrix corresponding to the number of pattern elements in the pattern;

e. accepting for each pattern area in the pattern a firing time for the dye applicators in each gun bar required to produce the pattern area, the firing time being the length of time during which a dye applicator projects dye onto the textile material substrate;

f. determining the values of control variables used to control the operation of subsequent steps in the method, the control variables comprising a number of firing commands to be issued to dye applicators for a pattern row, a firing command time interval associated which each of the firing commands, and an aggregate firing command time interval associated which each of the firing command time intervals g. determining if the dye applicator must, in accordance with the pattern information, project dye during the firing command time interval;

h. if the dye applicator must project dye during the firing command time interval, determining a required location in the firing command matrix in which a firing command must be placed so that the command will be executed when the portion of the substrate to which the pattern element on which the pattern area produced by the firing command is to be applied is within operative range of the dye applicator;

i. placing the firing command in the required location in the firing command matrix.

j. repeating steps (g.), (h.), and (i.) for each dye applicator in an array;

k. repeating steps (g.), (h.), (i.), and (j.) for each firing command time interval;

l. repeating steps (g.), (h.), (i.), (j.), and (k.) for each pattern row in the pattern;

m. repeating steps (g.), (h.), (i.), (j.), (k.), and (l.) for each array;

n. writing to each of a plurality of digital memories, one digital memory being associated with each array, the first firing command in the firing command matrix for each dye applicator in each array;

o. in response to a first control signal, transferring the firing command from the digital memory to each dye applicator in each array;

p. initializing the value of an elapsed time counter to correspond to the firing command time interval associated with the firing command;

q. loading the digital memory with the next firing command in the firing command matrix;

r. in response to a second control signal, being issued by the elapsed time counter when the firing command time interval has elapsed, transferring the firing command from the digital memory to each dye applicator in each array;

s. repeating steps (p.), (q.), and (r.) until all of the firing commands associated with a pattern row have been issued to the dye applicator; and t. repeating steps (o.) (p.), (q.), (r.), and (s.) iteratively until all of the firing commands in the firing command matrix have been issued.

12. An apparatus for applying a pattern of dye, the pattern comprising a pattern element matrix having a plurality of pattern elements in each of a plurality of pattern rows, to a textile material substrate comprising:

a. means for moving the textile material substrate along a path;

b. a plurality of gun bars arranged along the path in operative range of the textile material substrate, each gun bar having a plurality of dye applicators;

c. means for individually controlling the ejection of dye from each dye applicator onto the textile material substrate, said controlling means comprising:

i. means for determining a set of initial values, further comprising:

1. means for selecting the pattern comprising a two-dimensional pattern area code matrix, each element of the pattern area code matrix having a pattern area code identifying one of the pattern areas, a first dimension of the two-dimensional pattern area code matrix corresponding to the number of pattern rows in the pattern and a second dimension of the two-dimensional pattern area code matrix corresponding to the number of pattern elements in the pattern;

2. means for accepting for each pattern area in the pattern a firing time for the dye applicators in each array required to produce the pattern area, the firing time being the length of time during which a dye applicator projects dye onto the substrate;

3. means for determining the values of control variables comprising a number of firing commands to be issued to dye applicators for a pattern row, a firing command time interval associated which each of the firing commands, and an aggregate firing command time interval associated which each of the firing command time intervals; and ii. means for generating from the set of initial values a firing command matrix having, for each dye applicator in each gun bar, a firing command sequence corresponding to the pattern element to which that dye applicator may apply dye in each pattern row; and iii. means for allocating, for simultaneous transmission to each dye applicator in each array, the firing command sequence in the firing command matrix corresponding to the pattern element in the pattern row to be applied to the predetermined portion of the substrate that is passing within operative range of the dye applicator at the time of transmission.

13. The apparatus of claim 12 wherein the controlling means is a digital computer operatively coupled to an electrically operated valve associated with each dye applicator.

14. The apparatus of claim 12, wherein the means for selecting a pattern comprises of a means for identifying the pattern by name from among a plurality of named patterns.

15. The apparatus of claim 12, wherein the firing times for the selected pattern are contained in a two-dimensional firing time matrix with a first dimension corresponding to the number of arrays and the second dimension corresponding to the number of pattern areas in the pattern.

16. The method of claim 12, wherein the means for determining the values of control variables further comprises:

a. means for identifying distinct firing times required in the selected pattern;

b. means for sorting the distinct firing times into ascending order;

c. means for placing the sorted distinct firing times into a firing time string;

d. means for determining the number of firing commands required to produce a pattern row in the pattern, being one greater than the number of distinct firing times in the firing time string;

e. means for determining the effective number of pattern rows in the pattern, being the sum of the number of pattern rows in the pattern and the number of pattern rows contained in the maximum distance along the substrate between any two arrays;

f. means for determining the number of firing commands required to produce the pattern, being the product of the number of firing commands per pattern row and the effective number of pattern rows; and g. means for generating a firing command time interval string having its first element equal to the first element in the firing time string, and each remaining element equal to the difference between the firing time in the corresponding element of the firing time string and the next shortest firing time.

17. The apparatus of claim 12, further comprising:

a. means for determining if the number of pattern elements in the pattern rows of the pattern is less than the number of dye applicators in the arrays and, if so;

b. means for generating a transformed two-dimensional pattern area code matrix having a first dimension equal to the number of pattern rows in the pattern and a second dimension equal to the number of dye applicators in the arrays, containing pattern area codes identical to those in the pattern area code matrix repeated an integer number of times across the second dimension of the transformed pattern area code matrix, if possible, and containing in its remaining cells null values.

* * * * *

UNITED STATES PATENT AND TRADEMARK OFFICE

CERTIFICATE OF CORRECTION

PATENT NO. : 5,136,520

DATED : August 4, 1992

INVENTOR(S) : Steven Wayne Cox

It is certified that error appears in the above-identified patent and that said Letters Patent is hereby corrected as shown below:

Column 16, line 34, Claim 16 - delete "method" and insert —apparatus—

Signed and Sealed this

Twelfth Day of April, 1994

Bruce Lehman

*Attest:*

BRUCE LEHMAN

*Commissioner of Patents and Trademarks*

*Attesting Officer*